United States Patent [19]

Phillips

[11] 4,030,173

[45] June 21, 1977

[54] PIN HANDLING AND INSERTION MECHANISM

[75] Inventor: Jodie W. Phillips, Elmira, N.Y.

[73] Assignee: Corning Glass Works, Corning, N.Y.

[22] Filed: July 26, 1976

[21] Appl. No.: 708,499

[52] U.S. Cl. ..... 29/25.19

[51] Int. Cl.[2] ..... H01J 9/24

[58] Field of Search ..... 29/25.19, 25.2, 25.15; 65/138–139, 146, 154–155

[56] References Cited

UNITED STATES PATENTS

| | | | |
|---|---|---|---|
| 3,004,182 | 10/1961 | Pfaender | 29/25.19 X |
| 3,497,339 | 2/1976 | Eastus | 29/25.19 X |
| 3,695,860 | 10/1972 | Katuta | 65/154 |
| 3,724,740 | 4/1973 | Imamura et al. | 29/25.19 X |

*Primary Examiner*—Richard B. Lazarus
*Attorney, Agent, or Firm*—Charles W. Gregg; Burton R. Turner; Clarence R. Patty, Jr.

[57] ABSTRACT

A mechanism for handling and insertion, in surfaces of face plates or viewing panels for color television picture tubes for support of aperture masks, each of a plurality of relatively elongate support pins having a generally channel-shaped cross-sectional configuration, the mechanism being operable in cooperation with a heating means disposed adjacent said face plate for heating each of said pins prior to and for the purpose of the insertion thereof in said surfaces.

10 Claims, 9 Drawing Figures

PIN HANDLING AND INSERTION MECHANISM

BACKGROUND OF THE INVENTION

There is shown in copending patent application, Ser. No. 580,331, filed May 23, 1975 by Harris G. Rodgers, Sr. and entitled "Color Television Picture Tube Envelope," such application being assigned to the same assignee as the present application a picture tube envelope including a generally rectangular curved glass face plate having embedded, in each of the corner regions of the concave surface thereof, an end of a channel shaped pin for supporting an aperture mask adjacent such concave surface. Such aperture mask support pins may, for example, be of the type disclosed in copending patent application, Ser. No. 629,646, filed Nov. 6, 1975 by Harris G. Rodgers, Sr. and entitled "Pin for Supporting the Aperture Mask In a Color Television Picture Tube" such application being assigned to the same assignee as the present application and now issued U.S. Pat. No. 3,988,631.

In order that the above mentioned face plate or viewing panel manufacturing or fabricating operations may be performed as rapidly as possible and economic advantages thereby attained, a group of four pin insertion guns or mechanisms may, for example, be employed at a selected work station in an assembly line for simultaneous insertion, in each corner of each of a plurality, series or succession of panels being intermittently and sequentially moved along such assembly line, of an aperture mask support pin such as that mentioned. To expedite, to the extent possible, the movement of the panels through the selected work or pin insertion station in said assembly line, it is expedient that there be employed pin insertion guns or mechanisms which operate substantially automatically and relatively rapidly so that such guns or mechanisms are prepared for inserting a set of four pins in a succeeding panel or face plate moved into the pin insertion station as a preceding panel, in said succession thereof, is moved out of such station. It is, accordingly, an object of the present invention to provide a pin handling and insertion mechanism for automatically rapidly handling each of a plurality of aperture mask support pins of the type mentioned and for insertion of each of the pins into the glass of face plates or viewing panels for color television picture tubes. Such pin handling and insertion mechanism may be advantageously employed, for example, in conjunction with a pin feeding apparatus or mechanism such as disclosed in copending patent application, Ser. No. 702,697, filed July 6, 1976 by Lawrence W. Phillips et al. and entitled "Pin Feeding Mechanism" such application being assigned to the same assignee as the present application. However, if found to be convenient or to be expedient to do so, the pins may be manually supplied to the mechanism of the present invention.

Other objections and characteristic features of the invention will become apparent as the description proceeds.

BRIEF SUMMARY OF THE INVENTION

The invention is believed to be adequately summarized in the foregoing abstract of the disclosure and, therefore, for the sake of brevity and to avoid redundancy or repetition to the extent possible, no further summary of the invention will be given nor is any believed necessary.

BRIEF DESCRIPTION OF THE DRAWINGS

In the drawings.

Similar reference characters refer to similar parts in each of the Figs. of the drawings.

PREFERRED EMBODIMENT OF THE INVENTION

Figure 1:
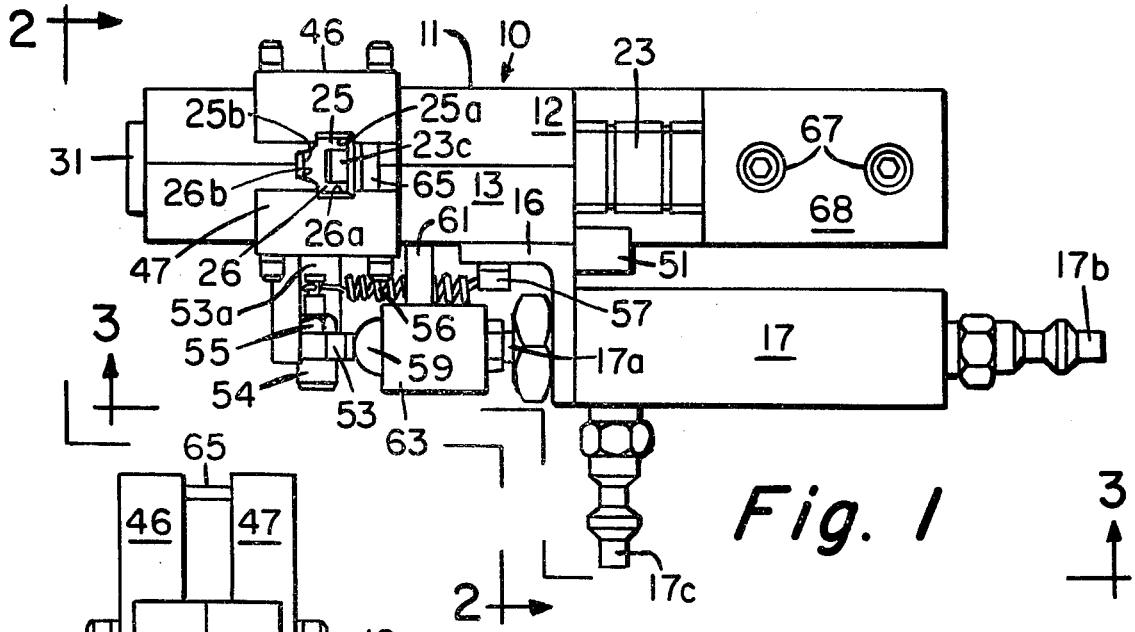
FIG. 1 is a top plan view of a pin handling and insertion mechanism embodying the invention.

Referring to the drawings in detail, there is shown the inventive mechanism 10 including a housing, or body or housing member 11 comprising first and second halves or a pair of sides 12 and 13, respectively, which are held together by a plurality of shoulder screws such as 14 (FIG. 2) screwed into suitably threaded holes such as **14*a*. A bracket 16 is attached to the outer surface of side or half 13 of housing member 11 and there is supported by such bracket first and second actuating or motor means shown as pressurized fluid cylinders 17 and 18, respectively, and including associated piston rods 17*a* and 18*a***, respectively, which actuate parts hereinafter discussed.

Figure 2:
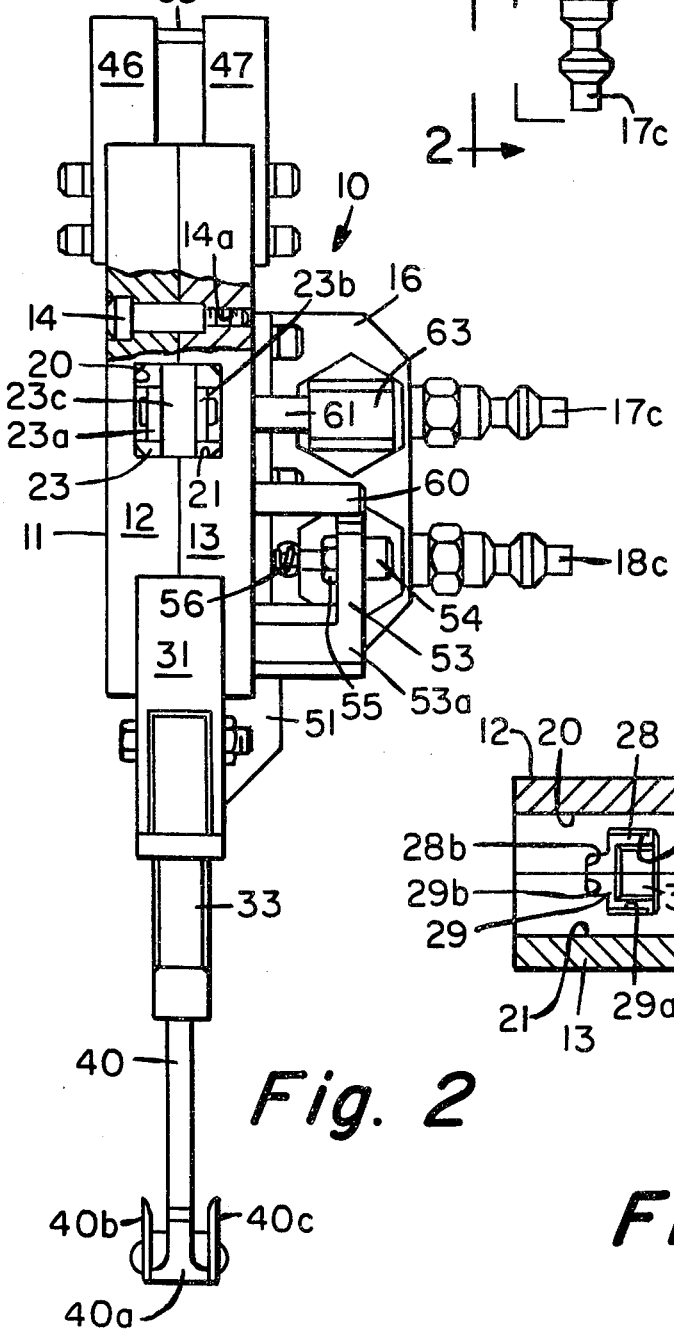
FIG. 2 is a front elevational view of the mechanism of FIG. 1, such view being taken generally along line 2—2 of FIG. 1 and a small part thereof being broken away to illustrate one of a plurality of screws used for holding parts of the mechanism together.
Figure 6:
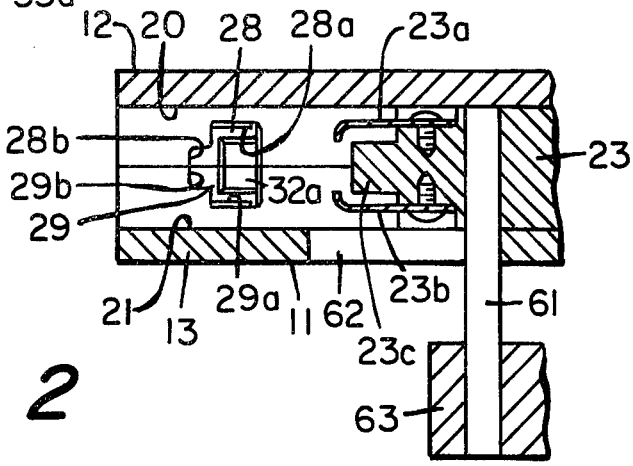
FIG. 6 is a cross-sectional view on an enlarged scale and taken generally along line 6—6 of FIG. 5.
Figure 4:
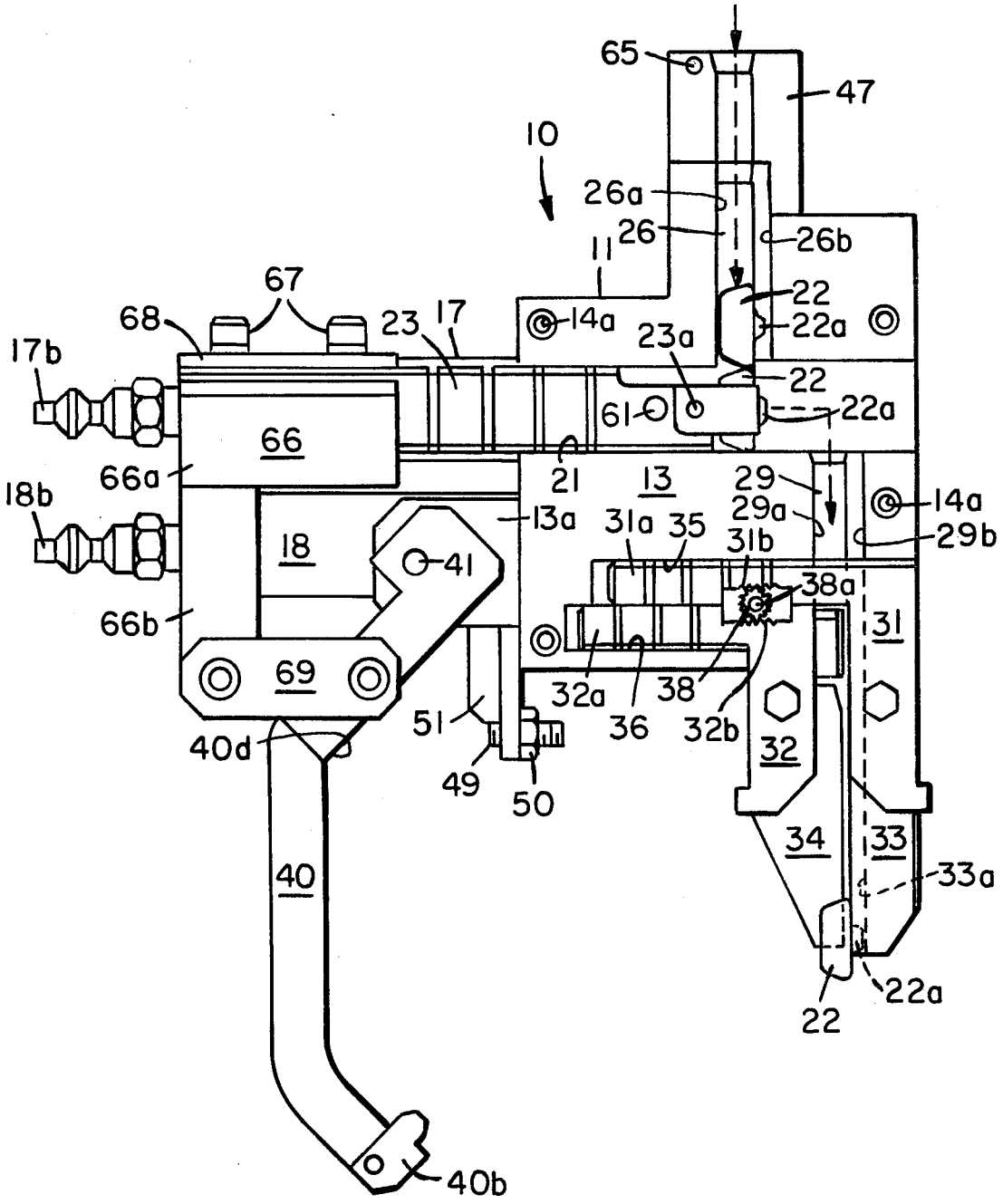
FIG. 4 comprises an elevational view taken from the second side of the mechanism of FIG. 1 with a side plate thereof removed to show internal construction of the mechanism.

As illustrated in FIG. 4, half or side 13 of housing or body member 11 is shown as embodying a first horizontally disposed or extending pin guide channel or passage 21 which has a height greater than the length of an aperture mask support pin such as 22 shown and such channel 21 is provided for sliding movement or conveyance of one or each of a plurality of such pins therethrough from a first end to a second end thereof and in a generally upright position or attitude. As shown in FIGS. 2 and 6, side or half 12 of housing or body member 11 embodies a channel or passage 20 which is a mirror image of channel or passage 21 in side or half 13 of the housing or body member 11, and a longitudinal slide member or slide means 23, to be hereinafter further discussed, fits snugly but slidably in passages 20 and 21 when said sides or halves 12 and 13 are attached to each other by said shoulder screws such as 14 as previously mentioned.

Referring further to FIG. 4, side or half 13 of body or housing member 11 further embodies a second pin guide channel or a generally upwardly extending pin receipt passage 26 for sliding movement or conveyance of therethrough of one or each of said pins such as 22 in a generally upright position or attitude thereof, such passage or channel having an upper end opening or extending through the upper wall of housing or body member 11 for receipt of said pin or each of said pins and a lower end connecting with said first end of said horizontal channel or passage 21. Pin receipt channel or passage 26 has a main portion 26*a* of a width slightly greater than the width of a side of each of the channel shaped pins such as 22 and a secondary portion 26*b* having a width slightly greater than the height of protrusions such as 22*a* which may be provided on and extend from the faces of some or all the pins 22. As shown in FIG. 1, side or half 12 of housing or body member 11 embodies a channel or passage 25 which is a mirror image of channel or passage 26 in side or half 13 of housing 11 and such channel or passage 25 includes a main portion 25*a* and a secondary portion 25*b* which correspond respectively to portions 26*a* and 26*b* of channel or passage 26. Thus, and as will be readily apparent to those skilled in the art, when sides 12 and 13 are attached to each other as previously mentioned, a substantially vertical pin receipt passage or pin guide channel is provided for receipt of pins supplied to the upper end of such passage or channel and conveyance of the pins to the first end of the aforesaid horizontal channel.

With further reference to FIG. 4 of the drawings, side or half 13 of housing or body 11 embodies a third pin guide channel or generally upwardly extending pin delivery passage 29 for sliding movement therethrough or conveyance of a pin or each of a plurality of pins such as 22 in a generally upright position or attitude thereof, such passage or channel having an upper end connecting with said second of said horizontal passage or channel 21 and a lower pin delivery end opening or extending through the lower wall of said housing or body member 11 for delivery of said pin or pins. Pin delivery passage or channel 29 has a main portion 29*a* of a width slightly greater than the width of a side of each of the channel shaped pins such as 22 and a secondary portion 29*b* having a width slightly greater than the height of protrusions such as 22*a* which may be provided on and extend from the faces of some or all of the pins such as 22. As shown in FIG. 6, side or half 12 of housing 11 embodies a channel or passage 28 which is a mirror image of channel or passage 29 in side or half 13 of housing or member 11 and such channel or passage 28 includes a main portion 28*a* and a secondary portion 28*b* which correspond respectively to portions 29*a* and 29*b* of channel or passage 29. When sides or halves 12 and 13 are attached to each other by the shoulder screws such as 14 as previously mentioned a substantially vertical pin delivery passage or pin guide channel is provided for conveyance and delivery of pins supplied to the upper end of such passage, as hereinafter discussed, to additional parts of the mechanism also discussed hereinafter.

A pair of inverted generally L-shaped upper and lower supports 31 and 32 for a pin clamping means, comprising a pair of jaws 33 and 34, are also shown in FIG. 4 and are slidably movable in upper and lower horizontal channels 35 and 36, respectively, also embodied in side or half 13 of housing 11, the lower and upper limits, respectively, of such channels being on a common line so that the lower and upper surfaces of the inverted base parts 31*a* and 32*a*, respectively, of supports 31 and 32 are in contact with each other with a sliding relationship existing between such surfaces. A lower portion of the base part 31*a* of support 31 is recessed and provided with a set of teeth 31*b* while an upper portion of the base part 32*a* of support 32 is similarly recessed and provided with a set of teeth 32*b*, such sets of teeth providing, in conjunction with a relatively small toothed wheel or pinion gear 38, to be hereinafter discussed, racks and pinion arrangements as will be readily apparent. As with slide member or means 23 previously discussed, only half of the horizontal thickness of base parts 31*a* and 32*a* of supports 31 and 32 extend into said channels 35 and 36, and the other half of said thicknesses extend into corresponding and complemental channels provided in half or side 12 of housing or body member 12 when members 12 and 13 are attached to each other, as will be readily recognized by those skilled in the art.

Figures 3, 7, 8, 9:
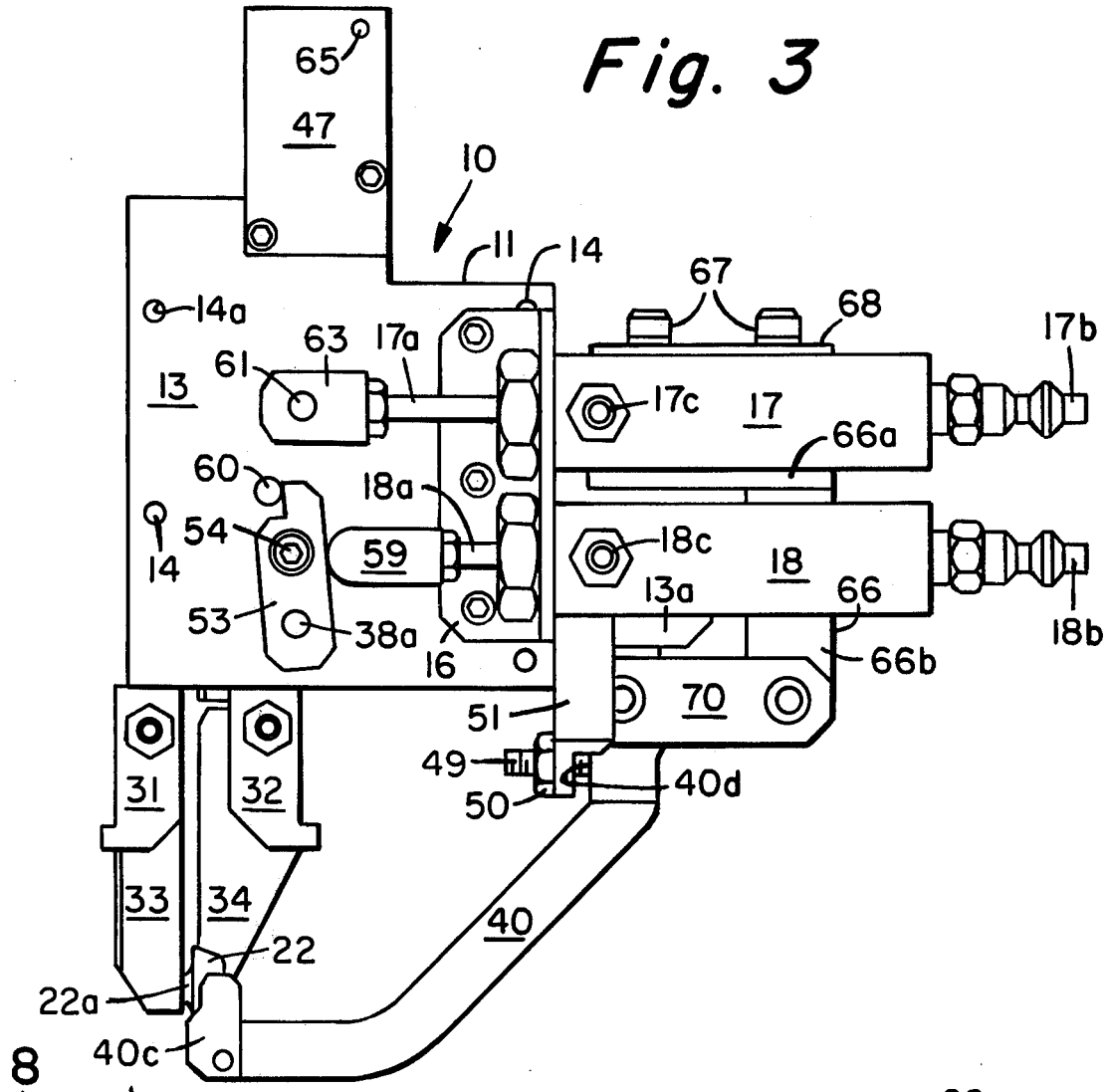
FIG. 3 is a side elevational view of a first side of the mechanism of FIG. 1, such view being taken generally along line 3—3 of FIG. 1 but with a part of the mechanism being shown in a different position than in FIG. 1.
FIG. 7 is a front elevational view, on an enlarged scale, of one type of an aperture mask support pin which the mechanism of the present invention is intended to conveniently handle.
FIG. 8 is a side elevational view of the pin of FIG. 7, such view being taken generally along line 8—8 of FIG. 7.
FIG. 9 is a top plan view of the pin of FIG. 7, such view being taken generally along line 9—9 of FIG. 7.

The clamping means or jaws 33 and 34 supported by supports 31 and 32 extend downwardly from the lower ends of supports 31 and 32 a substantial distance. Such jaws are preferably made of a material having low thermal conductivity, such as zirconium oxide for example, for more rapid heating of each pin supported thereby or clamped therebetween as hereinafter set forth. Jaw 34 has a thickness slightly smaller than the width of the channel in each channel pin such as 22 so that each such pin can slide down along the length of the face of such jaw while being guided thereby. Jaw 33 is provided with a relatively narrow channel 33*a* (FIG. 4) which extends the length of such jaw and into which the protrusion such as 22*a* on a pin such as 22 extends when the pin is provided with such a protrusion. Thus, a channel pin can slide downwardly between the facing surfaces or faces of jaws 33 and 34 when the clamping means are in their pin unclamping positions or conditions, that is, when the faces of jaws 33 and 34 are slightly spaced from each other as shown in FIG. 3.

Figure 5:
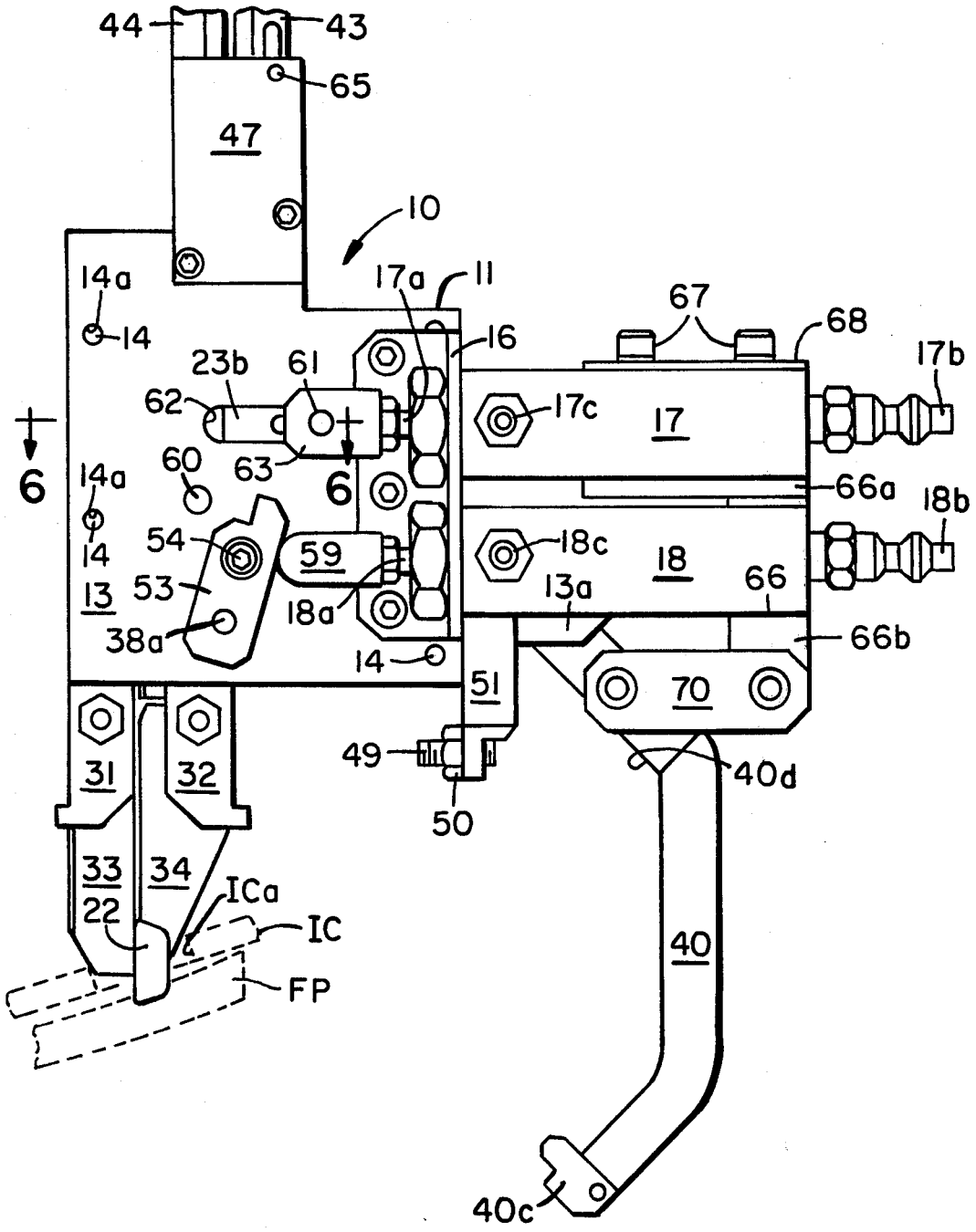
FIG. 5 is an elevational view similar to FIG. 3 but showing parts of the mechanism in different positions than in FIG. 3, and also illustrating a face plate and pin heating means with which the mechanism is employed.

An elongate somewhat semicircular and downwardly extending arm 40 is pivotally supported adjacent its upper end on a suitable pivot pin 41 (FIG. 4) which extends between a lateral extension 13*a* of side or half 13 of housing or body member 11 and a similar or corresponding extension (not shown) on side or half 12 of the housing or body member, such extensions being of a lesser thickness than the remainder of said sides or halves to provide a space between the extensions for receipt of said upper end of arm 40. Arm 40 has a thickness slightly less than the width of the channel in each of the channel pins such as 22 except at or adjacent the lower end of the arm where it has a wider portion 40*a* (FIG. 2) to the sides of which there is attached a pair of small leaves or plates 40*b* and 40*c* between which the sides of a channel pin will fit with the lower end of such pin resting on the upper surface of portion 40*a* of arm 40 when such arm is in the position shown in FIG. 3 and a pin such as 22 shown in such drawings, figure has slid downwardly between the faces of the aforesaid clamping jaws 33 and 34 to the lower ends of such jaws. Arm 40 is pivotally mounted on said pivot pin 41 so that the arm is reciprocatively movable or actuable between its position shown in FIGS. 4 and 5, and its position shown in FIG. 3, to provide for reciprocative movement of the lower end of the arm through an arc of travel from a first position (FIGS. 4 and 5)

where such end is substantially away from the lower ends of jaws 33 and 34, for clearance thereof, and the second position (FIG. 3) adjacent and below the lower ends of said jaws, that is, the lower end of the clamping means. Thus, the lower end of arm 40 provides a stop means for precisely limiting the distance each channel pin such as 22 extends downwardly from between the faces of said jaws, that is, can protrude from the lower end of the clamping means prior to clamping of each respective pin as hereinafter discussed.

To provide for adjustment of the distance a pin such as 22 will be permitted to protrude or extend from the lower end of jaws 33 and 34 by the stop means as discussed above, an adjustable screw stop is provided and comprises a threaded screw 49, a lock nut 50 and a support bracket 51. Such bracket is secured to the side of half 13 of housing 11 and has a threaded hole through which screw 49 extends so that its end will be contacted by a portion **40*d* of the edge of arm 40 when such arm is in its position shown in FIG. 3. As will be readily apparent to those skilled in the art, adjustment of the distance screw 49 extends through bracket 51 will adjust how closely the lower end 40*a* of arm 40 is moved adjacent to the lower ends of jaws 33 and 34 and, therefore, how far or the distance that the lower end of a pin such as 22 can protrude or extend out of the lower ends of said jaws for insertion into a surface of a face plate or viewing panel as previously mentioned. The arrangement for imparting the aforesaid reciprocative movement to arm 40** and the resulting movement of the lower end of such arm through its aforesaid arc of travel will be described hereinafter.

Returning to the previously mentioned pinion gear 38 (FIG. 4) such gear has an integral shaft **38*a* which extends through side or half 13 of housing 11 and to which is keyed, for rotation of shaft 38*a* and pinion gear 38, a shaft housing part 53*a* (FIGS. 1 and 2) of a relatively short lever arm 53. A screw 54 extends through a hole provided in lever arm 53 near the upper end thereof and such screw is secured in such hole by a lock nut 55 (FIGS. 1 and 2). A tensional coil spring 56 has one of its ends looped about screw 54 as shown in FIGS. 1 and 2, and the other end of spring 56 is attached to a stud 57 (FIG. 1) secured in aforesaid bracket 16. Through such arrangement, spring 56 maintains lever arm 53 in its position shown in FIG. 5 when the lever arm is not actuated to its position against a stop pin 60 as shown in FIGS. 1 and 3 and discussed below, such pin 60 being secured in half or side 13 of housing member 11**.

A first end of a lever contacting device or pusher 59 is connected, for actuation thereof, with one of the aforesaid actuating or motor means, that is, with the otherwise free end of the aforesaid piston rod **18*a* of pressurized fluid cylinder 18, and the second end of device or pusher 59 bears against the right hand edge (viewing FIGS. 1, 3 and 5) of lever arm 53 for actuation of such lever to its position shown in FIGS. 1 and 3 against the tensional force of tensional spring 56 when said actuating or motor means are energized in a first mode, that is, when pressurized fluid is supplied to a first end of cylinder 18 as hereinafter discussed. As lever arm 53 is actuated to its position shown in FIGS. 1 and 3, it imparts a limited amount of rotation to shaft 38*a* which, in turn, imparts rotation to pinion gear 38 (FIG. 4) to move, through the aforesaid rack and pinion arrangements, including gear 38 and teeth 31*b* and 32*b*, jaw supports 31 and 32 in right hand and left hand directions, respectively, to open jaws 33 and 34 as shown in FIG. 3. When said actuating or motor means are energized in a second mode, that is, when pressurized fluid is supplied to a second end of cylinder 18, pusher or lever contact device 59 is reactuated to its position shown in FIG. 5 and spring 56 returns lever arm 53 to its position also shown in FIG. 5 to move jaw supports 31 and 32 in left hand and right hand directions respectively (viewing FIG. 4) to correspondingly move jaws 33 and 34 toward each other to clamp a pin between the faces of the jaws as shown in FIGS. 4 and 5. It is expedient to here point out that motor or actuating means other than a pressurized fluid cylinder and associated piston rod could readily be used for the actuation of the apparatus as discussed above. As an example, an electrical solenoid coil and associated plunger could be used in place of cylinder 18 and piston rod 18*a***, respectively.

There extends into and is secured in previously mentioned longitudinal slide member or slide means 23 adjacent the left hand end thereof (viewing FIG. 6) a first end of an actuating rod 61 which extends, at about the center of such rod, through a slot 62 embodied in side or half 13 of housing 11 and having a width slightly greater than the diameter of rod 61. The second end of rod 61 extends into a block member 63 which is connected at one end thereof with the other of the aforesaid actuating or motor means, that is, with the otherwise free end of piston rod **17*a* of pressurized fluid cylinder 17 as shown in FIGS. 3 and 5. When said other motor or actuating means are energized in a first mode thereof, that is, when pressurized fluid is supplied to the left hand end of cylinder 17 (viewing FIG. 5), piston rod 17*a* is retracted within such cylinder as shown in FIGS. 1 and 5 and member 63 is moved to the position shown in such drawing, figures to correspondingly move rod 61 and, thereby slide member or means 23 to its position best shown in FIGS. 4 and 6. When such other motor or actuating means is energized in a second mode thereof, that is, when pressurized fluid is supplied to the right hand end of cylinder 17 (viewing FIG. 3) piston rod 17*a* is projected out of such cylinder as shown in FIG. 3 and member 63 is moved to the position shown in such figure to correspondingly move rod 61 and, thereby, slide member or means 23 along channels 21 and 23 in sides 12 and 13 of housing 11 (FIGS. 2 and 6) until the left hand end of slide member 23 (viewing FIG. 6) is above the upper end of channels or passages 28 and 29 in said halves or sides 12 and 13 for a purpose hereinafter discussed. It is believed expedient to here point out that motor or actuating means other than a pressurized fluid cylinder and associated piston rod could be conveniently used for the actuation of member 23 as discussed above. As an example, an electrical solenoid coil and associated plunger could be used in place of cylinder 17 and piston rod 17*a*, respectively, as in the case of cylinder 18 and piston rod 18*a*** discussed above.

Referring to FIG. 6, the left hand end of slide member or means 23 is recessed or stepped on both sides thereof to provide for securing a pair of channel pin support leaf members **23*a* and 23*b* to the sides of slide means 23. (See also FIGS. 4 and 5). The free ends of leaf members 23*a* and 23*b* curve inwardly toward each other as shown in FIG. 6 and, in conjunction with a narrowed or stepped end 23*c* of member 23 provide a channel having a configuration for supporting a channel pin such as 22** in an upright position or attitude thereof as shown in FIG. 4, the protrusion 22*a* on such channel pin extending at such time between the curved ends of leaf members 23*a* and 23*b* while the channel in such pin 22 bridges said narrowed or stepped end 23*c* of member 23. It is believed that this will be readily apparent to those skilled in the art from a brief glance at FIGS. 4 and 6 of the drawings.

There is shown in FIGS. 3, 4 and 5 an inverted L-shaped member 66 whose inverted base portion 66*a* is connected to the left hand end (viewing FIG. 4) of previously discussed slide member or slide means 23 for movement therewith, such connection being made by a pair of bolts such as 67 which extend downwardly through a backup plate 68 and slide member 23, and into suitably threaded holes provided in said base portion 66*a* of L-shaped member 66. The inverted upright portion 66*b* of L-shaped member 66 is of a substantially lesser thickness than base portion 66*a* of such member and a pair of first and second link members 69 and 70 are pivotally connected adjacent first ends thereof to the lower end of portion 66*b* of member 66 on opposite sides thereof, the second ends of link members 69 and 70 being pivotally connected to opposite sides of previously discussed arm 40 to provide, as discussed below, the previously discussed reciprocative movement of such arm and corresponding movement of the lower end of the arm through its aforesaid arc of travel or movement.

By the above described arrangement, when slide member or means 23 is reciprocatively moved by piston rod 17*a* of cylinder 17 as previously discussed, member 66 is correspondingly moved to, in turn, actuate or move link members 69 and 70, and thereby supply the aforesaid movement to arm 40. For example, when slide member or means 23 is moved to the right (viewing FIG. 4) arm 40 is moved correspondingly so that its lower end ends up below and adjacent to the lower ends of jaws 33 and 34 as shown in FIG. 3. When slide member 23 is moved to the left (viewing FIG. 4) arm 40 is correspondingly moved so that the lower end thereof is moved away from said lower end of said jaws to the location of said arm lower end illustrated in FIG. 4. This provides clearance of said jaws for a pin insertion such as hereinafter discussed.

As previously mentioned, channel pins can be manually supplied to the pin handling and insertion mechanism disclosed but, for the purpose of utilizing the disclosed mechanism at its maximum speed and resulting economic efficiency, it is expedient that the pin handling and insertion mechanism be employed with a pin feeding mechanism such as disclosed in the aforesaid copending application, Ser. No. 702,697 of Lawrence W. Phillips et al. and, to such end, there are shown attached to the sides or halves 12 and 13 of housing 11, adjacent the upper edges thereof, a pair of adaptors or connecting blocks 46 and 47, respectively, as best illustrated in FIG. 2 and, as illustrated in FIG. 5, a pair of spacer members 43 and 44 of the pin feeding mechanism of said copending application of Lawrence W. Phillips et al. can extend downwardly between adaptors or connecting blocks 46 and 47, the pin 65 shown extending between such connector blocks or adaptors in FIG. 2 extending, at such time, through a slot shown in spacer block 43 in FIG. 5. The reference characters 43, 44, 46 and 47 discussed above correspond respectively to the similar reference characters 43, 44, 46 and 47 shown at the lower part of FIG. 1 of the above mentioned Phillips et al. copending application and reference may be made to such application if more information is desired relative to the manner in which the mechanism of the present invention may be used in conjunction with the pin feeding mechanism of such copending application.

It is pointed out that, when sides or halves 12 and 13 of housing 11 are connected together as shown in FIGS. 1 and 6, passages or channels 25 and 26 shown in FIG. 1 and passages or channels 28 and 29 shown in FIG. 6 form channels which have a cross-sectional configuration substantially corresponding to the cross-sectional shape of a channel pin or channel-shaped pin such as pin 22 shown in FIGS. 7, 8 and 9, such shape being substantially the same as the shape of the end of a pin as illustrated in FIG. 9. However, it should also be pointed out that the mechanism 10 of the present invention can be used with pins of shapes other than that specifically shown in said drawing FIGS. 7, 8 and 9. For example, mechanism 10 could be used with pins having a hole or slot in place of the pin protuberance or protrusion 22*a* shown in drawing FIGS. 7, 8 or 9, or with channel-shaped pins having other than the geometric symmetry shown in such drawing figures. Furthermore, the mechanism of the present invention could be readily adapted to handle pins, other than channel-shaped pins such as that shown, by changing the cross-sectional configuration of the channels or passages mentioned above and the shapes of other parts of the mechanism so that they will suitably handle pins of such different shapes, such changed channel or passage configurations and part shapes depending, of course on the shape of the pins to be handled.

BRIEF OPERATIONAL EXAMPLE OF THE INVENTION

Referring to FIG. 5 there is shown by broken lines a pancake type of electrical induction pin heating coil designated IC, having a center hole IC*a* therein, and a portion of a face plate designated FP into which it is intended that the lower end of an aperture mask support pin such as 22 be inserted as shown in FIG. 5. Coil IC and mechanism 10 may, for example, be supported by a suitable vertically actuable bracket (not shown) with the lower ends of the jaws 33 and 34, that is the lower end of the clamping means comprising such jaws, adjacent to and above the center hole IC*a* in coil IC. Such a vertically actuable bracket for supporting mechanism 10 and coil IC is not shown in the drawings since it does not, per se, form a part of the present invention. However, a bracket such as that mentioned can be attached to coil IC and mechanism 10 in any convenient manner.

Assuming that mechanism 10 and coil IC are supported as mentioned above, a channel pin such as 22 shown in FIGS. 7, 8 and 9 is either manually or automatically supplied in an upright position or attitude to the upper end of the aforesaid passage formed by channels 25 and 26 (FIGS. 1 and 4) and such pin is conveyed or slides down such passage to between leaf members 23*a* and 23*b* attached to slide member 23 (FIGS. 4 and 6) and the pin comes to rest with the lower ends of its sides resting on the surfaces defining the bottom wall of channels 20 and 21 as best illustrated in FIG. 4. It is believed expedient to here point out that pusher 59 is shown in FIG. 1 in its position shown in FIG. 3 but, at the time under discussion, such pusher is actually in its position shown in FIG. 5 and lever arm 53 is also in its position shown in FIG. 5, such lever arm being actuated to such position by the tensional force of spring 56.

It will now be assumed that pressurized fluid is supplied to a conduit connection 18*b* provided on the right hand end of cylinder 18 (viewing FIGS. 3 and 5) while a conduit connection 18*c*, provided on the side of cylinder 18 adjacent the left hand end thereof when viewing FIGS. 3 and 5 (see also FIG. 2) is connected to a fluid sink or to atmosphere. Such conduit connections provide, of course, fluid passages leading to their respectively associated ends of the interior of cylinder 18. Said pressurized fluid is supplied from a suitable source thereof through a suitable fluid flow control valve and conduit to said connection 18*b* and said connection 18*c* is connected through a suitable conduit and said control valve to said fluid sink or atmosphere. Such fluid source, valve, conduits and fluid sink do not, per se, form a part of the present invention and, therefore, are not shown in the drawings. However, such fluid flow control arrangements and parts mentioned are well known in the art.

The above mentioned pressurized fluid supplied to conduit connection 18*b* causes piston rod 18*a* of cylinder 18 to be actuated out of cylinder 18 to cause pusher 59 to be moved to its position shown in FIGS. 1, 2 and 3, and correspondingly move lever arm 53 against the force of tensional spring 56. Such movement of lever arm 53 actuates the clamping means including jaws 33 and 34 to their open positions or conditions shown in FIG. 3 in preparation for receipt of a pin between the faces of said jaws as illustrated.

Following the above described initial operations, pressurized fluid is supplied from said source thereof to a conduit connection 17*b* connected to the right hand end of cylinder 17 (viewing FIG. 3) while a conduit connection 17*c*, provided on the side of cylinder adjacent the left hand end thereof when viewing FIG. 3, is connected to atmosphere or to the aforesaid or another fluid sink. Such conduit connections are similar to those provided on cylinder 18 discussed above and said supply of fluid to said connection 17*b*, as well as the connection of conduit connection 17*c* to the fluid sink or atmosphere, are also made through a suitable fluid flow control valve and associated conduits as will be readily apparent to those skilled in the art.

The pressurized fluid supplied to conduit connection 17*b* causes piston rod 17*a* of cylinder 17 to be actuated out of cylinder 17 to cause member 63 to be moved to its position shown in FIG. 3 thereby moving slide means or member 23 (FIGS. 4 and 6) to slide or convey the pin 22, supported on the end of such member or means, to a position over or above the upper end of the passage formed by channels 28 and 29 in halves 20 and 21 of housing 11. Simultaneously with such movement or conveyance of pin 22, support member 66 is carried or moved by slide member or means 23 to its position shown in FIG. 3, such movement of member 66 actuating through link members 69 and 70 the previously described movement of arm 40 and the lower end thereof through its aforesaid arc of travel to its position below and adjacent to the lower end of jaws 33 and 34 as shown in FIG. 3. Thus, when the pin 22 arrives at the upper end of said passage 28–29 (FIG. 6) and is conveyed or slides down through such passage, and out of the lower end thereof and between the faces of jaws 33 and 34 to the lower ends thereof as illustrated in FIG. 3, and into the hole IC*a* in coil IC as shown in FIG. 5, the lower end of arm 40 limits the distance the lower end of the pin 22 can extend out of the lower ends of said jaws as previously mentioned.

Following the above described delivery or conveyance of pin 22 to its position shown in FIG. 3, the aforesaid fluid flow control valve controlling the flow of fluid to cylinder 18 is actuated to reverse the fluid flow to such cylinder, that is, to supply pressurized fluid to conduit connection 18*c* while connecting conduit connection 18*b* to the fluid sink or atmosphere. Such actuation of the valve causes piston rod 18*a* to be retracted within cylinder 18 to move pusher 59 out of contact with lever arm 53 which is returned by the contraction of spring 56 to its position shown in FIG. 5 to actuate the lower ends of the faces of jaws 33 and 34 against pin 22 to clamp it therebetween as illustrated in FIGS. 4 and 5.

Subsequent to said clamping of the pin the aforesaid fluid flow control valve controlling the flow of fluid to cylinder 17 is actuated to reverse the fluid flow to such cylinder, that is, to supply pressurized fluid to conduit connection 17*c* while connecting conduit connection 17*b* to the fluid sink or atmosphere. Such actuation of the valve causes piston rod 17*a* to be retracted within cylinder 17 to reactuate slide member or means 23 to its position shown in FIG. 4 for receipt of another support pin supplied to or already in passage 25–26 (FIG. 1), such actuation of member or means 23 also moving arm 40 in its opposite direction so that the lower end thereof is moved away from and clear of the lower end of jaws 33 and 34, coil IC and the pin clamped and supported therebetween.

Pin 22 being in the center hole IC*a* in coil IC for heating of the pin, previously mentioned face plate FP is moved to near its position shown in FIG. 5, that is, to a position such that the upper surface thereof is slightly spaced from the lower end of pin 22. The electrical power for energizing coil IC for the resultant heating of pin 22 is supplied to such coil and, following sufficient heating of the pin, the aforesaid bracket or other means supporting mechanism 10 is actuated downwardly so that the lower end of the pin enters the upper surface or layers of the glass of face plate FP to the distance illustrated in FIG. 5, such distance being limited by the distance to which the lower end of the pin was permitted to extend below the lower ends of jaws 33 and 34 by the stop means comprising the lower end of arm 40 as previously mentioned. When the lower end of pin 22 is inserted or embedded in face plate FP to the desired distance, or slightly prior thereto, the power to coil IC is terminated and the pin and the glass surrounding it are permitted to cool to allow the pin to become firmly affixed in the face plate. It is pointed out that means other than an induction such as IC could be used for heating of the pins such as 22. For example, suitable gas burners could be employed for such heating if found expedient or desirable to do so.

After the glass surrounding the pin has cooled sufficiently to become set up and the pin is satisfactorily affixed in the face plate, the pressurized fluid to cylinder 18 is again reversed to cause jaws 33 and 34 to open as previously described and thereby unclamp the pin. The bracket or other means supporting mechanism 10 and coil IC is then actuated upwardly for upward actuation of such mechanism and coil while face plate FP is moved downwardly to clear the mechanism and coil in preparation for insertion of another pin in another face plate. By the above mentioned unclamping of the inserted pin, mechanism 10 is prepared for another actuation thereof in the manner described, and the resulting handling and clamping of another pin in preparation for insertion in another viewing panel or face plate such as FP.

Although there is herein shown and described in detail only one form of a mechanism embodying the invention, it will be understood that such is not intended to be in any way limiting but that various changes and modifications may be made therein within the purview of the appended claims without departing from the spirit and scope thereof.

I claim:

1. In the manufacturing of face plates for color television picture tubes each having inserted, in one surface thereof for support of an aperture mask adjacent to such surface, an end of at least one of a plurality of relatively elongate pins each having a U-shaped channel cross-sectional configuration taken on a plane normal to the length thereof; and, in combination with a heating means intermittently disposed adjacent said one surface of each of said face plates, a mechanism for handling said plurality of pins and intermittently positioning each said pin adjacent said heating means for heating thereof and subsequent insertion of its end into said one surface of the respective face plate adjacent with such heating means is then disposed, said mechanism comprising;

A. a housing member disposed above said heating means, such housing member embodying;

I. a first pin guide channel having a height greater than the length of each of said pins and extending generally horizontally in said housing, a second pin guide channel for conveyance of each of said pins in a generally upright position thereof such channel having a lower end connecting with a first end of said first channel and an upper end extending through the upper wall of said housing for receipt of each of said pins, and a third pin guide channel for conveyance of each of said pins in a generally upright position thereof such channel having an upper end connecting with the second end of said first channel and a lower pin delivery end extending through the lower wall of said housing; and II. slide means arranged for reciprocative movement between first and second positions in said first channel for receipt and conveyance of each of said pins in said generally upright position thereof from said lower end of said second channel to said upper end of said third channel for delivery of the pin to such end of such third channel;

B. a pair of facing and generally vertically extending jaws having upper ends disposed adjacent said lower pin delivery end of said third channel, such jaws being actuable between first spaced-apart positions for receipt, between the upper ends of the faces thereof, of each of said pins delivered thereto from said third channel lower delivery end, and second positions for clamping part of each received pin therebetween, the face of one of said jaws having a width generally corresponding to and slightly smaller than that of the channel in each of said pins for sliding movement and guidance of such pins along such one jaw from said upper to said lower ends of said faces of the jaws for said clamping of said part of each of the pins therebetween;

C. stop means arranged for reciprocative movement between a first position substantially away from said jaws for clearance thereof and a second position adjacent and below the lower ends of said jaw faces for precisely limiting the distance each of said pins can extend downwardly from between said faces prior to said clamping of each of the respective pins;

D. resilient means for force biasing said jaws to their said second positions;

E. first motor means for imparting said reciprocative movements to said slide means and said stop means for simultaneous movement thereof from their said first positions to their said second positions and from their said second positions to their said first positions; and F. second motor means reciprocatively actuable between two positions and associated with said jaws for movement thereof and their said faces away from each other for receipt of each of said pins therebetween when such motor means are actuated from one to the other of their said two positions against the force of said resilient means, such resilient means again force biasing said jaws to their said second positions when the second motor means are actuated from said other to said one of their said two positions.

2. A mechanism in accordance with claim 1 and in which said motor means are pressurized fluid actuated cylinders and respectively associated piston rods.

3. A mechanism in accordance with claim 1 and in which said resilient means is a tensional spring.

4. A mechanism in accordance with claim 1 and in which said jaws comprise a refractory material.

5. A mechanism in accordance with claim 2 and in which said resilient means is a tensional spring.

6. A mechanism in accordance with claim 2 and in which said jaws comprise a refractory material.

7. A mechanism in accordance with claim 3 and in which said jaws comprise a refractory material.

8. A mechanism for handling and insertion in a face plate for a color television picture tube a relatively elongate aperture mask support pin having a generally U-shaped channel cross-sectional configuration taken on a plane normal to the length of such pin and operable in cooperation with a heating means disposed adjacent said face plate for heating of said pin prior to and for said insertion thereof, said mechanism comprising, in combination;

A. a generally upright disposed body member including therein,

I. a generally horizontally disposed passage for sliding movement of said pin therethrough in a generally upright position thereof from a first end to the second end of such passage, II. a pin receipt passage for sliding movement of said pin therethrough in said upright position and having an upper end opening through the upper wall of said body member for receipt of said pin and a lower end connecting with said first end of said horizontal passage, III. a pin delivery passage for sliding movement of said pin therethrough in said upright position and having an upper end connecting with said second end of said horizontal passage and a lower end opening through the lower wall of said body member for delivery of said pin, and IV. a slide member disposed at times in a first position in said horizontal passage for receipt of said pin from said receipt passage and for support and sliding movement of the pin through such horizontal passage to a second position of such slide member above said delivery passage;

B. upright pin clamping means normally in a non-clamping condition and actuable to a clamping condition and having an upper end disposed below said lower end of said delivery passage for receipt of said pin therefrom, such clamping means, when in the non-clamping condition, guiding said pin to their lower end for subsequent clamping of the pin, such lower end being disposed adjacent said heating means;

C. means for actuating such clamping means from and to each said condition thereof;

D. stop means actuable between a first position, away from said lower end of said clamping means for clearance thereof and a second position adjacent and below said lower end of said clamping means for limiting the distance the lower end of said pin can protrude from such clamping means lower end for insertion into said face plate; and E. means for actuating said slide member and said stop means simultaneously from their said first positions to their said second positions and from their said second positions to their said first positions.

9. A mechanism in accordance with claim 8 and in which said clamping means comprises a set of facing jaws of a refractory material.

10. A mechanism in accordance with claim 8 and in which said actuating means including pressurized fluid cylinders and respectively associated piston rods.

* * * * *